US007213589B2

(12) United States Patent
Eichner et al.

(10) Patent No.: US 7,213,589 B2
(45) Date of Patent: May 8, 2007

(54) COMPRESSED-GAS GUN

(75) Inventors: Frank Eichner, Bergheim (DE); Ulrich Hess, Bergheim (DE)

(73) Assignee: Hans Eichner GmbH & Co. KG, Bergheim (DE)

( * ) Notice: Subject to any disclaimer, the term of this patent is extended or adjusted under 35 U.S.C. 154(b) by 64 days.

(21) Appl. No.: 10/993,099

(22) Filed: Nov. 19, 2004

(65) Prior Publication Data

US 2005/0183711 A1 Aug. 25, 2005

Related U.S. Application Data

(63) Continuation of application No. PCT/EP03/05521, filed on May 27, 2003.

(30) Foreign Application Priority Data

May 28, 2002 (DE) ..... 202 08 287 U

(51) Int. Cl.
*F41B 11/32* (2006.01)

(52) U.S. Cl. ..... 124/77; 124/73; 124/74; 89/1.34

(58) Field of Classification Search ..... 124/73, 124/74, 77; 89/1.34
See application file for complete search history.

(56) References Cited

U.S. PATENT DOCUMENTS

| | | | | | |
|---|---|---|---|---|---|
| 279,539 | A | * | 6/1883 | Chamberlain | 102/375 |
| 387,256 | A | * | 8/1888 | Pratt | 222/3 |
| 495,767 | A | | 4/1893 | Winans | |
| 2,098,068 | A | * | 11/1937 | Skinner | 102/444 |
| 2,327,653 | A | * | 8/1943 | Lisle | 124/57 |
| 2,581,758 | A | | 1/1952 | Galliano | |
| 2,780,213 | A | | 2/1957 | Collins et al. | |
| 2,855,715 | A | * | 10/1958 | Weimer | 42/58 |
| 2,998,810 | A | | 9/1961 | Anastasia et al. | |
| 3,212,489 | A | * | 10/1965 | Merz | 124/74 |
| 3,369,609 | A | | 2/1968 | Fogelgren | |
| 3,374,708 | A | * | 3/1968 | Wall | 89/1.11 |
| 3,612,026 | A | * | 10/1971 | Vadas et al. | 124/76 |
| 4,173,211 | A | * | 11/1979 | Crawford, Jr. | 124/45 |
| 4,483,088 | A | * | 11/1984 | Tussing | 42/1.05 |
| 4,531,458 | A | * | 7/1985 | Saxby | 102/440 |
| 4,697,366 | A | * | 10/1987 | Frisoli | 42/1.05 |
| 4,819,609 | A | * | 4/1989 | Tippmann | 124/72 |
| 5,187,323 | A | * | 2/1993 | Saxby | 102/440 |
| 5,272,983 | A | * | 12/1993 | Sippel et al. | 102/469 |

(Continued)

FOREIGN PATENT DOCUMENTS

| | | |
|---|---|---|
| DE | 2227114 | 12/1973 |

(Continued)

*Primary Examiner*—Michael J. Carone
*Assistant Examiner*—Stewart T. Knox
(74) *Attorney, Agent, or Firm*—Friedrich Kueffner

(57) ABSTRACT

A compressed gas injection device includes a projectile course for receiving and accelerating projectile bodies, a compressed gas housing which is connected to the projectile course and which is divided up into a compressed gas chamber and a working chamber by a partition. A working piston is arranged in the compressed gas housing and is provided with a valve plate which is arranged on the front end of the piston rod thereof for moveable rear closure of the projectile course, wherein the working piston is a movable backward closure element for the working chamber and the piston rod is guided through the partition.

10 Claims, 1 Drawing Sheet

U.S. PATENT DOCUMENTS 5,335,600 A * 8/1994 Horr et al. ..... 102/470
5,349,938 A * 9/1994 Farrell ..... 124/73
5,361,700 A * 11/1994 Carbone ..... 102/439
5,845,629 A * 12/1998 Ratliff ..... 124/56
5,962,805 A * 10/1999 Saxby ..... 102/440
6,257,271 B1 * 7/2001 Babin et al. ..... 137/315.17
6,343,599 B1 * 2/2002 Perrone ..... 124/73
6,427,600 B2 * 8/2002 Saxby ..... 102/444
6,502,568 B2 * 1/2003 Kunimoto ..... 124/73
2005/0257783 A1 * 11/2005 Tippmann, Jr. ..... 124/73

FOREIGN PATENT DOCUMENTS

WO 9813660 4/1998

* cited by examiner

COMPRESSED-GAS GUN

CROSS-REFERENCE TO RELATED APPLICATION

This application is a continuation of International Patent Application Serial No. PCT/EP03/05521 filed May 27, 2003 which, in turn, claims the priority of German Patent Application 202 08 287.3 filed May 28, 2002, both of which are hereby incorporated by reference in their entirety.

BACKGROUND OF THE INVENTION

1. Field of the Invention

The invention concerns a compressed-gas gun (impulse gun) that utilizes the action of an expanding compressed gas, preferably compressed air, to fire single-piece projectile bodies, filled projectile bodies, or projectile bodies attached to an accessory device. The invention also relates to a method for removing damage using a compressed-gas gun.

2. Description of the Related Art

Shooting devices of a wide variety of designs are generally known. The different purposes for which shooting devices are used usually also require the use of different means of accelerating the projectile body and the use of different devices that are suitable for the purpose at hand. Examples of areas of application include:

- the introduction of substances into places or locations that are exposed but poorly accessible or that pose a risk to the safety of personnel (firefighting, the triggering of an avalanche, etc.),
- the shooting of auxiliary lines and rescue lines, first-aid packages, etc.,
- the introduction of agents for protecting persons or property (tear gas, warfare agents, etc.).

Both solid material (plastic, rubber, metals, etc.) and hollow bodies (filled with various types of solid, liquid, or gaseous charges, depending on the purpose of use) can be used as projectile bodies. In addition, special devices (rescue lines, auxiliary lines, etc.) can be attached to a projectile body, which serves as the carrier. Depending on the application, the projectile bodies can have different sizes, weights, shapes, or material compositions.

DE 2 227 114 A describes an arcade-type gun with a "bullet" barrel that can be connected with a source of compressed gas and with an additional blind barrel for a cartridge, which is connected by a gas channel with the loading end of the bullet barrel, so that a cartridge (blank cartridge) fired in the cartridge blind barrel becomes the source of compressed gas for the bullet barrel, and this compressed gas then shoots a bullet located at the loading end of the bullet barrel through the bullet barrel. The acceleration of the bullet is only moderate, but it is sufficient for the recreational purpose.

U.S. Pat. No. 3,369,609 A describes a compressed-gas gun for projecting fire extinguishing grenades, which consists of a gun barrel and a compressed-gas casing. The compressed-gas casing is divided into two pressure chambers by a stationary partition. In the fire-ready position, in which both chambers are filled with compressed gas, a valve stem, which is guided through the partition and has valves mounted on its ends, closes the breech with the front valve in the front pressure chamber, and closes a valve port that opens into the atmosphere with the rear valve in the rear pressure chamber. Both valves are in a state of equilibrium by virtue of the pressure of the compressed gas and of the valve stem that connects them, so that both valves are pressed tightly against their valve ports. To fire this compressed-gas gun, the compressed gas from the rear pressure chamber is discharged into the atmosphere, which causes the equilibrium to be altered in such a way that the front valve is opened by the valve stem, and the gas pressure present in the front pressure chamber propels the grenade through the gun barrel. The disadvantages of this previously known compressed-gas gun include especially its very expensive and complicated design.

U.S. Pat. No. 2,581,758 describes a compressed-gas gun for propelling harpoons or the like. It consists of a barrel with a compressed-gas casing, which is likewise divided into two chambers by a stationary partition. A slidable plunger, whose plunger rod is guided through the wall, is installed in the rear chamber (the working chamber), and in the front chamber (the compressed-gas chamber), a valve cap presses against the open end of the barrel; compressed gas introduced into the compressed-gas chamber and a compression spring, one end of which abuts against the plunger, provide for sufficient contact pressure. To fire this compressed-gas gun, compressed gas is admitted into the working chamber through a line, thereby pushing the plunger and opening the front valve by the plunger rod connected to the valve, and the harpoon is ejected by the compressed gas that is present.

Furthermore, methods and devices are known for the local destruction of compact materials, for example, slag incrustations, masonry residues, etc., in hot thermal installations and plants, such as heat exchangers, industrial furnaces, fuel firing plants, and metallurgical melting crucibles, in which an explosive is used, which is placed at the forward end of a lance, brought into the immediate vicinity of the material to be destroyed by supporting and moving the rear end of the lance through an opening of the hot thermal installation, and then ignited by means of an ignition device at a freely selectable time. However, devices of this type are unsuitable for use at greater distances from the compact materials.

SUMMARY OF THE INVENTION

With these considerations in mind, the objective of the invention is to specify a compressed-gas gun with a simple and lightweight design that can be universally used for the various applications that have been enumerated. In particular, it should allow the removal of dirt, incrustations, baked-on materials, coatings, etc., and the elimination of disturbances of material flow (blockages, loosening) of bulk materials. Furthermore, handling should be especially simple and inexpensive.

The stated objective is achieved by a compressed-gas gun that utilizes the action of an expanding compressed gas, preferably compressed air, to discharge single-piece projectile bodies, filled projectile bodies, or projectile bodies attached to an accessory device. The compressed-gas gun of the invention consists of:

- a gun barrel for receiving and accelerating the projectile body,
- a compressed-gas casing, which is connected with the gun barrel and divided by a partition into a compressed-gas chamber and a working chamber, and
- a working piston installed in the compressed-gas casing with a valve plate mounted on the forward end of its piston rod for the movable rear closure of the gun barrel, such that the working piston is designed as a movable rearward termination of the working chamber, and the piston rod is guided through the partition.

In accordance with the invention, this compressed-gas gun is characterized by the fact that (a) only the working piston (7), which can be moved as far as the rear wall (17) of the compressed-gas casing (5), is located inside the working chamber, and the piston rod (6) of the working piston (7) is supported in the compressed-gas chamber (11) on the partition (10) with a spring element, for example, a compression spring (9), and (b) the compressed-gas chamber (11) has an intake valve (14), which is designed as a check valve, for supplying compressed gas and is connected with the working chamber (12) by a control valve (15).

Advantageous embodiments of the invention are specified in the dependent claims.

The mode of operation of the compressed-gas gun of the invention is based on the following operating characteristics:

In the fire-ready position, stored compressed gas closes the rear cross-sectional area of the gun barrel loaded with a projectile body by means of a valve plate.

When the discharge operation is triggered, this valve plate is opened by the same compressed gas.

The compressed gas expands in the completely uncovered cross section of the gun barrel behind the projectile body, thereby propelling the projectile body from the gun barrel.

The individual components of the simply designed compressed-gas gun are operatively connected with one another in the following way for the possible occurrence of these successive steps:

In the fire-ready position, i.e., the position in which the gun is ready to be discharged, the compressed-gas chamber contains a stored compressed gas at a pressure of about 5–10 bars, which entered the compressed-gas chamber through an intake valve, for example, by connection to an interchangeable compressed-gas cartridge or a compressed-gas tank or a continuously operating compressed-gas generator through a compressed-gas line.

The gas discharge port of the compressed-gas chamber to the gun barrel is closed by the valve plate connected with the piston rod, and closure is maintained by the compressed gas pressing against the valve plate on one side from the compressed-gas chamber. There is no compressed gas in the working chamber, which is separated from the compressed-gas chamber by the partition, apart from small amounts of leakage, which may occur from the compressed-gas chamber through the partition via the piston-rod guide.

The projectile body to be discharged is located in the gun barrel immediately in front of the valve plate. To trigger discharge, the control valve connecting the compressed-gas chamber with the working chamber is opened. In accordance with an advantageous embodiment of the invention, the control valve is servo-controlled to ensure that the control valve opens suddenly and without any time lag. The compressed gas flows from the compressed-gas chamber into the working chamber through the now open control valve. This leads to pressure equalization in the two chambers, i.e., the rear wall of the working chamber, which is formed by the movable working piston, is acted upon by the same pressure that is acting on the valve plate but in the opposite direction.

Since the effective cross-sectional area of the valve plate is smaller than that of the working piston, the force acting on the working piston by the compressed gas is greater than the force acting on the valve plate by the compressed gas. This differential force acting in the direction of the working piston causes the working piston to move away from the partition, and the valve plate, which is connected to the working piston by the piston rod, also moves in the same direction and thus opens the gun barrel closure. The compressed gas present in the compressed-gas chamber can then expand into the gun barrel, which is now open at the rear, and discharges the projectile body present in the gun barrel forward and out of the gun barrel with high impulse energy. To produce the best possible transformation of energy, the valve plate is designed only slightly larger than the cross section of the projectile body or the cross-sectional area of the gun barrel.

After the compressed gas has completely expanded, the piston rod is pushed back by a spring element, which is supported on the partition in the compressed-gas chamber. This also causes the valve plate to be pushed back to the rear end of the gun barrel into the closed position. It is now possible to reload the gun barrel with a new projectile and to fill the compressed-gas chamber with "fresh" compressed gas.

The gun barrel can be loaded either manually through the gun barrel or, in accordance with a refinement of the invention, semiautomatically (for several projectiles) through a magazine device installed in the area of the rear end of the gun barrel.

In accordance with another refinement of the invention, to simplify especially the process of loading complicated projectile bodies, the gun barrel is detachably connected with the compressed-gas casing, for example, by a bayonet coupling, which provides a simple means of making the rear end of the gun barrel accessible. Alternatively, however, the projectile body can also be introduced into the gun barrel from the front.

To allow the projectile body to be aimed with the necessary accuracy for the wide variety of applications mentioned above, in accordance with the invention, the compressed-gas gun is provided with a sighting device. For example, this can be a simple mechanical sighting device (cross hair) or, optionally, an adjustable (laser) sighting device. In this connection, it is advantageous to mount the compressed-gas gun on a stand, which is possible without any problems due to its low weight.

The compressed-gas gun, which can be universally used due to the simplicity of its design and handling, is suitable especially for the following potential areas of application:

1. Removal of baked-on materials, incrustations, coatings, and other types of fouling on:

surfaces (tops, walls, bottoms) in boilers of large-scale fuel firing plants, thermal installations, absorbers, hydroelectric plants;

heating packages or surfaces (evaporators, reheat superheaters, superheaters, etc.) in large-scale fuel firing plants, thermal installations, absorbers;

plants and plant parts;

pipelines, flues and pure gas ducts, air ducts;

tanks, storage bins, bunkers.

2. Elimination of disturbances of material flow (supply and disposal):

elimination of blockages;

loosening of bulk materials and fluid or flowable media.

3. Elimination of factors that impair the operational process:

removal of "ice curtains", e.g., on condensers;

removal of icing (incrustation) on refrigeration units, filling stations, or the like;

removal of icicles.

4. Introduction of substances into places or locations that are exposed but poorly accessible or that pose a risk to the safety of personnel:

shooting special projectile bodies filled with agents for fire protection, fire extinguishing, or explosion protection;

introduction of substances, chemicals, etc., into other media or environments (specifically, also in installations whose surrounding area has a high fire risk, gas tanks, containers that contain explosive gases);

injection of water (artificial lakes, fishponds, etc.) with water-improving chemicals, introduction of special bacterial cultures for water purification, for example, oil-digesting or sludge-digesting strains, binding chemicals, or other media;

smothering of fires by the introduction of extinguishing agents or special explosives in fires involving hazardous materials, e.g., chemicals, oil, fires in oil wells, oil transport equipment (platforms, ships, etc.), fires on means of hazardous material transport (tankers, trains, trucks), containers that contain flammable media;

introduction of media/chemicals for the prevention of fires (fire-retardant substances on plant parts, sealing of surfaces with fire-retardant substances);

introduction of chemicals, fertilizers, herbicides, pesticides, fungicides, and insecticides on farmland or other cultivated areas;

targeted introduction of explosive charges, for example, for triggering avalanches;

introduction of corrosion inhibitors in inaccessible sites.

5. Introduction of accessory devices (by means of special projectiles) into places or locations that are exposed but poorly accessible or that pose a risk to the safety of personnel by firing auxiliary lines, rescue lines, or other objects:

as a bow line to ships for material and personnel conveyance between individual ships or for fastening to a ship in distress during sea rescue operations;

as a lightweight line in bridge construction (building construction) for pulling support cables;

as an auxiliary line in power line construction for pulling the cable ropes as a safety line in mountain rescue;

firing objects for rescue operations in inaccessible terrain (first-aid packages, medications).

6. Introduction of media for protecting persons or property, for example, warfare agents, tear gas, irritant gas, marking agents, marking dyes, blinding agents, pepper spray.

The above list of possible areas of use and potential applications of the compressed-gas gun of the invention not only testifies to the versatility of this device but also shows that this compressed-gas gun opens up potential applications that it has not been possible to realize with conventional guns. This applies especially to the use of filled and thus correspondingly sensitive projectile bodies.

Other details, features and advantages of the invention are explained in greater detail below with reference to the specific embodiment illustrated in the drawings.

DETAILED DESCRIPTION OF THE INVENTION

Figure 1:
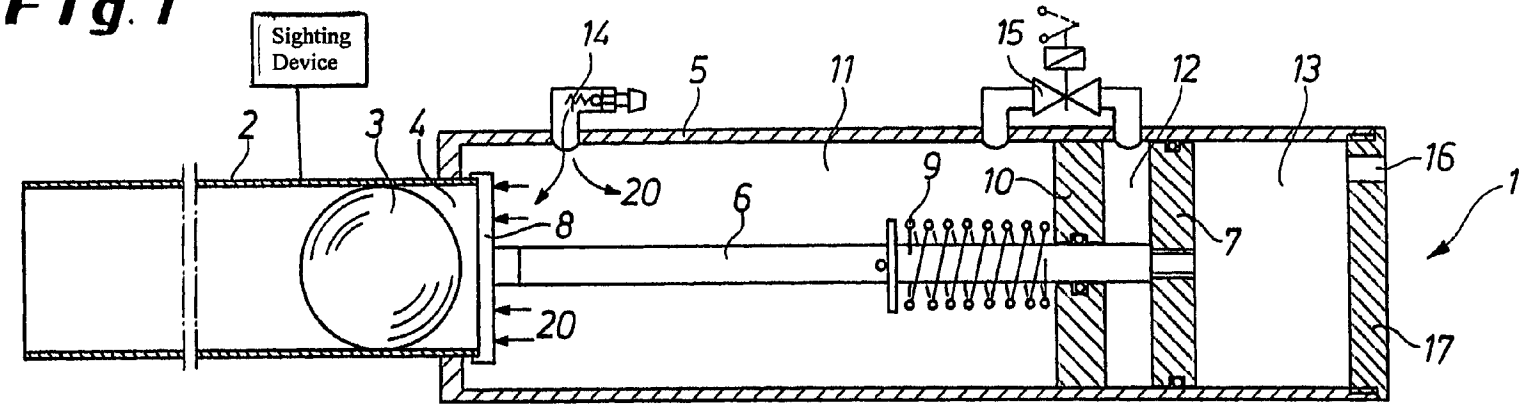
FIG. 1 shows a compressed-gas gun of the invention in the fire-ready position.
Figure 2:
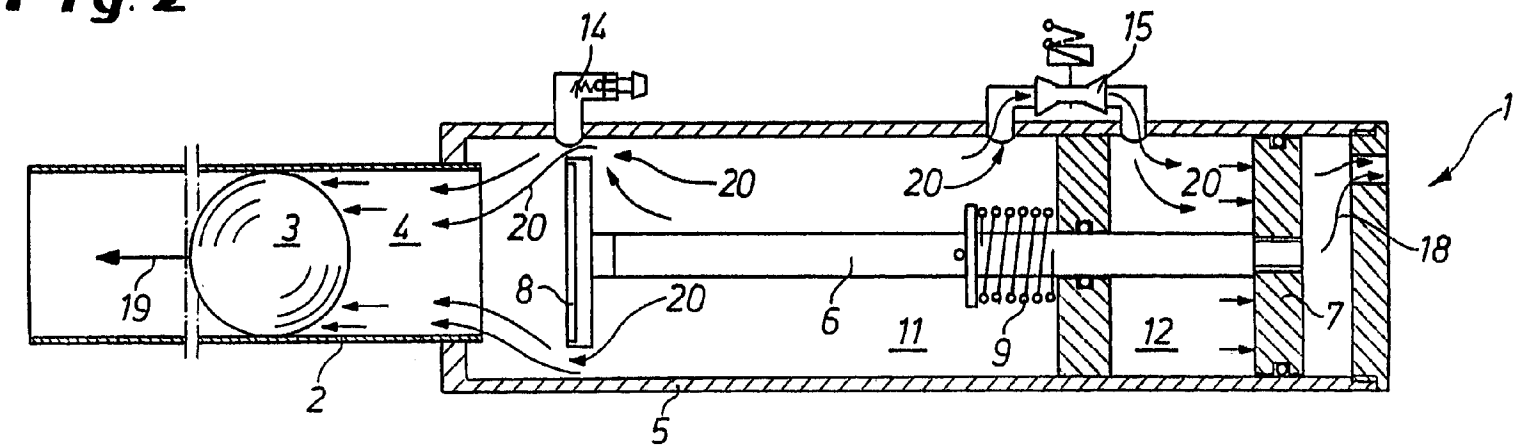
FIG. 2 shows the compressed-gas gun in the fired position.

In FIG. 1 and FIG. 2, the compressed-gas gun 1 consists essentially of two joined components, the gun barrel 2 and the compressed-gas casing 5. The compressed-gas casing 5 is bounded at its forward end (the left end in the drawing) by the gun barrel 2 and at the opposite end by the rear wall 17 of the casing. Inside the compressed-gas casing 5, there is a stationary partition 10, which divides the compressed-gas casing 5 into a compressed-gas chamber 11 and a working chamber 12. The piston rod 6 of a working piston 7 is guided through this partition 10. A valve plate 8 is mounted on the end of the piston rod 6 that is located in the compressed-gas chamber 11 (the left end in the drawing). The valve plate 8 seals the gun barrel 2, which opens into the compressed-gas chamber 11. Inside the compressed-gas chamber 11, the piston rod 6 is joined with a spring element 9, which is supported on the partition 10 and presses the valve plate 8 tightly against the rear part of the gun barrel 2 via the piston rod 6, thereby sealing the expansion space 4 to the projectile body 3.

At the other end of the piston rod 6, i.e., the end located in the working chamber 12, the working piston 7 is arranged and dimensioned in such a way that it forms a sealed rear wall of the working chamber 12. As a result of the piston rod 6 being pushed towards the gun barrel 2 by the spring element 9, the working piston 7 is located close to the partition 10, so that the working chamber 12 formed between the partition 10 and the working piston 7 is small, and the remaining clearance 13 between the working piston 7 and the rear wall 17 of the casing 5 is large. Gas discharge bores 16 are located in the rear wall 17 of the casing to allow pressure equalization when the working piston 7 moves axially inside the clearance 13.

The compressed-gas chamber 11 and the working chamber 12 are connected with one another by a control valve 15 in the immediate vicinity of the partition 10. In the fire-ready position of the compressed-gas gun 1 in accordance with FIG. 1, this control valve 15 is closed.

In the forward region of the compressed-gas chamber 11, an intake valve 14 designed as a check valve is mounted on the compressed-gas casing 5 for connection to a compressed-gas generator or compressed-gas tank. The compressed gas 20 that enters the compressed-gas chamber 11 through this intake valve 14, together with the spring element 9, then pushes the valve plate 8 tightly against the rear opening of the gun barrel 2. The compressed-gas gun 1 is ready to be discharged as soon as the compressed-gas chamber 11 is filled with compressed gas 20 at a pressure of about 5–10 bars.

FIG. 2 shows the compressed-gas gun 1 as it is being fired. When the control valve 15 is opened, a portion of the compressed gas 20 flows from the compressed-gas chamber 11 into the working chamber 12, in which it pushes against the working piston 7, which then moves axially (to the right in the drawing) due to its larger surface area compared to the valve plate 8, thereby increasing the volume of the working chamber 12. This also causes the piston rod 6 and the valve plate 8 to move in the same direction. This movement also causes the spring element 9 to be compressed and the clearance 13 to be diminished, and the air 18 present in the clearance is pushed to the outside through the gas discharge bores 16.

The movement of the valve plate 8 caused by the working piston 7 causes the entire cross-sectional area in the rear part of the gun barrel 2 to be suddenly uncovered, and the compressed gas 20 rapidly and completely expands in the expansion space 4 that forms and continuously increases behind the projectile body 3, thereby recoillessly pushing the projectile body 3 forward and out of the gun barrel 2 in the direction of arrow 19.

After the gun has been fired, the control valve 15 is closed, and the intake valve 14 is opened to allow the admission of compressed gas and to produce a state of firing readiness for automatic or semiautomatic reloading with one or more projectile bodies 3.

The measures and refinements in accordance with the invention are not limited to the specific embodiment illustrated in the drawings. Possible modifications of the device of the invention can involve, for example, different types of designs and arrangements of the valves and/or the spring element. The compressed-gas casing can also have different cross-sectional shapes. The internal design of the compressed-gas casing, the use of any suitable materials and the specific structural design can be freely adapted to special applications by an individual skilled in the art.

LIST OF REFERENCE NUMBERS

1 compressed gas gun
2 gun barrel
3 projectile body
4 expansion space
5 compressed-gas casing
6 piston rod
7 working piston
8 valve plate
9 spring element
10 partition
11 compressed-gas chamber
12 working chamber
13 rearward clearance
14 intake valve
15 control valve
16 gas discharge bore
17 rear wall of casing
18 air
19 arrow indicating discharge direction of the projectile body
20 compressed gas

The invention claimed is:

1. Compressed-gas gun (1) that utilizes the action of an expanding compressed gas (20) to fire one of the group consisting of solid projectile bodies (3), hollow projectile bodies (3), and projectile bodies (3) attached to an accessory device, which compressed-gas gun (1) comprises a gun barrel (2) for receiving and accelerating the projectile body (3) and a compressed gas casing (5), which is connected with the gun barrel (2) and divided by a partition (10) into a compressed-gas chamber (11) and a working chamber (12), wherein a working piston (7) installed in the working chamber (12) as a movable rearward termination of the working chamber (12) has a piston rod (6), which is guided through the partition (10), and the front end of the piston rod (6) has a valve plate (8) forming a movable rear closure of the gun barrel (2), wherein (a) only the working piston (7), which can be moved as far as a rear wall (17) of the compressed gas casing (5), is located inside the working chamber (12), and the piston rod (6) of the working piston (7) is supported in the compressed gas chamber (11) on the partition (10) with a spring element (9), and (b) the compressed gas chamber (11) has an intake valve (14), which is designed as a check valve, for supplying compressed gas and is connected with the working chamber (12) by a control valve (15).

2. Compressed-gas gun (1) in accordance with claim 1, wherein the control valve (15) that connects the compressed gas chamber (11) with the working chamber (12) is a servo controlled control valve.

3. Compressed-gas gun (1) in accordance with claim 1, wherein the valve plate (8) has an effective cross-sectional area that is at least equal to the clear cross-sectional area of the gun barrel (2) and is smaller than the effective cross-sectional area of the working piston (7).

4. Compressed-gas gun (1) in accordance with claim 1, wherein the compressed-gas chamber (11) is at least one of continuously and detachably connected via the intake valve (14) with a compressed-gas generator or with a compressed-gas tank.

5. Compressed-gas gun (1) in accordance with claim 1, wherein the gun barrel (2) is detachably connected with the compressed-gas casing (5).

6. Compressed-gas gun (1) in accordance with claim 1, wherein the gun barrel (2) is provided with a sighting device.

7. Compressed-gas gun (1) in accordance with claim 1, wherein a compressed gas (20) with a filling pressure of about 5–10 bars is used.

8. Compressed-gas gun (1) in accordance with claim 7, wherein kinetic energy imparted to the projectile body (3) by the compressed gas (20) is sufficient to break off dirt, incrustations, coatings, etc., on plants and plant parts to be cleaned upon impact of the projectile body (3).

9. Compressed-gas gun (1) in accordance with claim 1, wherein the compressed-gas gun (1) is designed in such a way that it is able to shoot special cartridgelike projectile bodies (3) for the purpose of introducing substances, chemicals, biological components, etc., even over large distances, into places or locations that are exposed but poorly accessible or that pose a risk to the safety of personnel.

10. Compressed-gas gun (1) in accordance with claim 1, wherein the spring element is a compression spring.

* * * * *